US009857151B2

(12) United States Patent
Dionne et al.

(10) Patent No.: US 9,857,151 B2
(45) Date of Patent: Jan. 2, 2018

(54) RING FIRE PRIMER

(71) Applicant: General Dynamics Ordnance and Tactical Systems—Canada Inc., Repentigny (CA)

(72) Inventors: Sylvain Dionne, Repentigny (CA); Pierre Duchesne, Repentigny (CA); Eric Toutant, Repentigny (CA)

(73) Assignee: General Dynamics Ordnance and Tactical Systems—Canada, Inc., Repentigny (CA)

( * ) Notice: Subject to any disclaimer, the term of this patent is extended or adjusted under 35 U.S.C. 154(b) by 0 days.

(21) Appl. No.: 15/029,740

(22) PCT Filed: Oct. 20, 2014

(86) PCT No.: PCT/CA2014/051010

§ 371 (c)(1),
(2) Date: Apr. 15, 2016

(87) PCT Pub. No.: WO2015/058294

PCT Pub. Date: Apr. 30, 2015

(65) Prior Publication Data

US 2016/0238355 A1 Aug. 18, 2016

Related U.S. Application Data

(60) Provisional application No. 61/893,567, filed on Oct. 21, 2013.

(51) Int. Cl.

| | |
|---|---|
| ***F42B 5/32*** | (2006.01) |
| ***F42C 19/10*** | (2006.01) |
| ***F42C 19/08*** | (2006.01) |

(52) U.S. Cl.
CPC ..... *F42B 5/32* (2013.01); *F42C 19/083* (2013.01); *F42C 19/10* (2013.01)

(58) Field of Classification Search
CPC ..... F42B 5/32; F42C 19/0823; F42C 19/083; F42C 19/10
See application file for complete search history.

(56) References Cited

U.S. PATENT DOCUMENTS 3,516,357 A * 6/1970 Hendricks ..... F42B 5/02 102/470
3,777,664 A * 12/1973 Gawlick ..... F42C 19/10 102/204

(Continued)

OTHER PUBLICATIONS

International Bureau of WIPO, International Preliminary Report on Patentability in PCT/CA2014/051010, dated May 6, 2016.

(Continued)

*Primary Examiner* — Gabriel Klein
(74) *Attorney, Agent, or Firm* — LKGlobal | Lorenz & Kopf, LLP

(57) ABSTRACT

An ammunition primer assembly is provided that includes, but is not limited to a cup having a base and a sidewall, a priming composition located in the cup and disposed on the base, an anvil located in the cup an upper surface, a lower surface and a side surface abutting the sidewall. The anvil defining a central channel formed therethrough. A portion of the base of the cup forms a striking surface. The striking surface is adjacent to a portion of the primer composition that is adjacent to the lower surface of the anvil. The striking surface is offset from a center of the cup.

18 Claims, 7 Drawing Sheets

(56) References Cited

U.S. PATENT DOCUMENTS

| | | | | |
|---|---|---|---|---|
| 3,786,761 | A | 1/1974 | Ciccone et al. | |
| 7,302,890 | B2 | 12/2007 | Saxby | |
| 9,217,626 | B1 * | 12/2015 | Hajjar | F42B 7/04 |
| 2010/0300319 | A1 * | 12/2010 | Guindon | C06C 7/00 102/430 |
| 2011/0192306 | A1 * | 8/2011 | Galluzzi | B29C 49/78 102/204 |
| 2013/0255126 | A1 | 10/2013 | Saxby | |
| 2016/0209186 | A1 * | 7/2016 | Hajjar | F41A 19/25 |

OTHER PUBLICATIONS

International Searching Authority of WIPO, International Search Report and Written Opinion in International Application No. PCT/CA2014/051010, dated Jan. 12, 2015.

* cited by examiner

RING FIRE PRIMER

CROSS REFERENCE TO RELATED APPLICATIONS

This is a U.S. National-Stage entry under 35 U.S.C. §371 based on International Application No. PCT/CA2014/051010, filed Oct. 20, 2014, and which claims priority to U.S. Provisional Patent Application No. 61/893,567, filed Oct. 21, 2013, which are all incorporated in their entirety by reference.

TECHNICAL FIELD

The technical field relates to ammunition and more specifically to a ring fire primer.

BACKGROUND

Typical ammunition cartridges employ a centerfire cartridge where a primer is located in the center of the cartridge case head. The primer sits in a cartridge case pocket which may be replaceable from the ammunition cartridge. When the firing pin/striker strikes the center of a cup containing a priming composition, the force created on the primer between the base of the cup and an anvil located in the cup ignites the primer. This sets in motion a chemical reaction which leads to the ignition of the priming composition which ignites the propellant (when applicable) resulting in the discharge of the projectile.

Rimfire primer cartridges also exist. In this arrangement, the firing pin/striker hits the rim of the base of the cartridge. The rim of the cartridge contains the priming compound or composition. The priming composition is not replaceable from the ammunition cartridge. Rimfire cartridges have become largely obsolete for use in military or law enforcement applications.

There is a need in many applications, including training exercises, to develop ammunition that cannot be fired using conventional centerfire primer and firing pin/striker arrangements. Live ammunition is constructed using a centerfire arrangement to be discharged by weapons that are designed to have the firing pin/striker strike the center of the base of the ammunition. There is therefore a need to develop efficient and cost efficiently produced primers that will not ignite when the center of the base of the primer is struck by a firing pin/striker or striker.

SUMMARY

An ammunition primer assembly is provided for use in association with an ammunition cartridge. The ammunition primer assembly comprises a percussion primer located in a primer well. The primer can be activated only by striking the primer cup off center.

According to one embodiment, there is provided an ammunition primer assembly comprising a cup having a base and a sidewall, a priming composition located in the cup and disposed on the base, which is optionally a sealing membrane, and an anvil located in the cup. The anvil has an upper surface, a lower surface and a side surface abutting the sidewall. The anvil defines a central channel formed from the lower to the upper surface or vice versa. A portion of the base of the cup forms a striking surface. The striking surface is adjacent to a portion of the priming composition that is adjacent to the lower surface of the anvil, wherein the striking surface is offset from a center of the cup.

According to another embodiment, there is provided a kit comprising an ammunition primer assembly and a firearm. The ammunition primer assembly includes: a cup having a base and a sidewall; a priming composition located in the cup and disposed on the base; an anvil located in the cup, the anvil having an upper surface, a lower surface and a side surface abutting the sidewall, and the anvil defining a central channel formed therethrough. A portion of the base of the cup forms a striking surface, the striking surface being adjacent to a portion of the priming composition that is adjacent to the lower surface of the anvil and offset from a center of the cup, wherein the striking surface is offset from a center of the cup. The firearm adapted or otherwise configured to receive the ammunition primer assembly, the firearm comprising a firing pin/striker and a firing pin/striker mechanism for operating the firing pin/striker, a chamber, a barrel and bolt carrier mechanism, at least one of the firing pin/striker, the chamber, the barrel and the bolt/bolt carrier mechanism being re-positioned such that the firing pin/striker is adapted to strike the striking surface.

DETAILED DESCRIPTION

Figure 1:
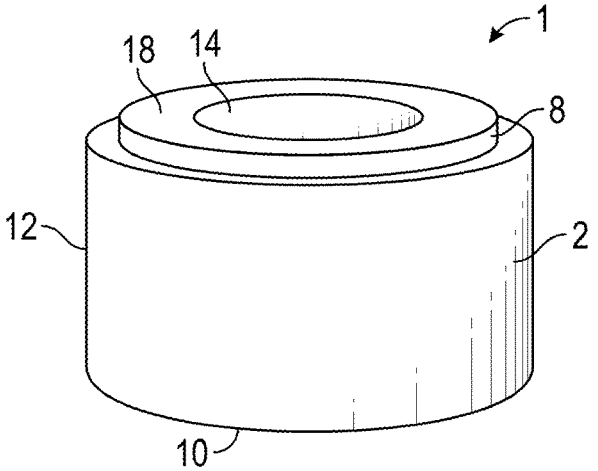
FIG. 1 is a perspective view of a primer according to an embodiment.
Figure 2:
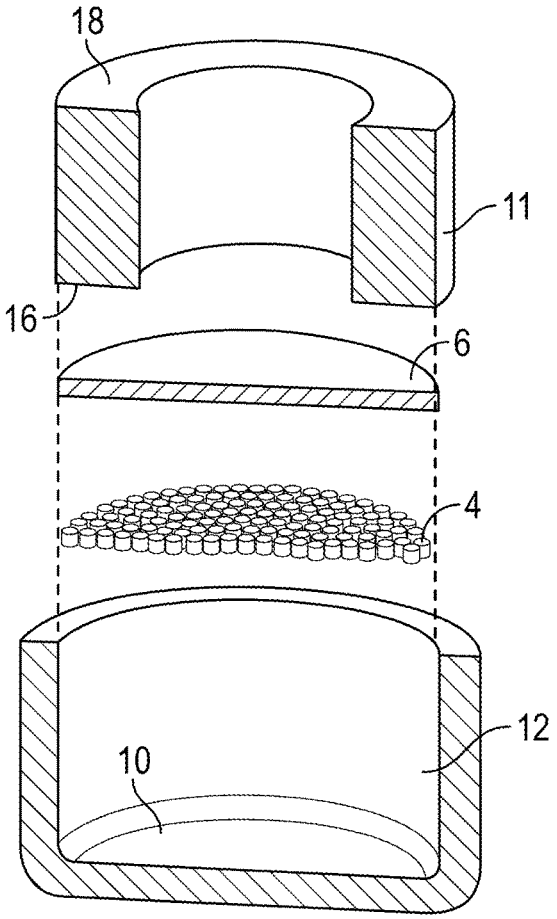
FIG. 2 is an exploded view of the primer.
Figure 3:
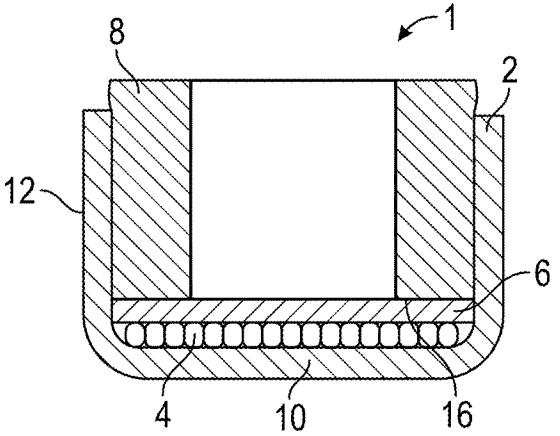
FIG. 3 is a cross-sectional view of the primer.

Primer assembly 1 comprises a cup 2. The cup 2 has a base 10 and a sidewall 12. The cup 2 includes an igniting priming composition 4. Preferably, the priming composition 4 is located on the base 10 of the cup 2. The priming composition of the primer may be for example, leaded, lead free, non-toxic among other options. The priming composition 4 may also be as described in U.S. Patent Application Publication No. 2010/0300319, which is hereby incorporated in its entirety by reference.

An anvil 8 is received in the cup 2. The anvil 8 is sized to be received in the cup 2. Preferably, the anvil 8 fits snugly into the cup 2. The anvil 8 has a lower surface 16, an upper surface 18 and a side surface 11 that abuts the sidewall 12 of the cup 2. The lower surface 16 of the anvil 8 has a central channel 14 formed therethrough such that a central portion of the lower surface 16 is not adjacent to the priming composition 4. As a result of the central channel 14 formed through the anvil, the primer located in the central part of the primer cup is not in contact with any part of the anvil.

The anvil 8 is preferably cylindrical in shape but may have other shapes in alternate embodiments. For example, in an alternate embodiment, the anvil 8 may be conical in shape. The lower surface 16 is preferably flat but may have a rounded shape, flat shape, or other shapes. The anvil 8 may optionally have an opening on the side surface 11. The anvil 8 is preferably made of brass. However, the anvil 8 may also be made of other metallic material or non-metallic material.

A portion of the base 10 that is adjacent to a portion of the priming composition 4 that is adjacent to the lower surface 16 of the anvil 8 forms a striking surface. Along the striking surface, the priming composition is effectively interposed between the primer cup and the lower surface 16 of the anvil. Since the priming composition 4 abuts the striking surface of the base 10 of the cup 2, the striking of the striking surface by a firing pin/striker will result in the activation of the priming composition 4 due to the pressure and deformation applied to the portion of the priming composition 4 that is interposed between the base 10 of the cup 2 and the lower surface 16 of the anvil 8. Due to the channel formed through the anvil 8, the striking surface is offset from a center of the base 10 of the cup 2. The circular striking surface is offset from the center of base 10 to the cup 2 by an amount which is determined by the diameter of the firing pin/striker or striker tip and the diameter of the primer cup. The off center distance can be varied depending on the shape and dimensions of the anvil 8 and the cup 2. The primer cup is usually made of brass cut but could be made of other material. The shape and thickness of the cup are made in order to accommodate the firing pin/striker impact force, as to provide enough deformation to have ignition of the priming composition.

Preferably, a sealing membrane 6 is located along a portion of the base 10 of the cup 2. The sealing membrane is preferably located between the priming composition and the anvil. The sealing membrane is preferably made of paper.

The primer assembly 1 can be used in various types of ammunition or devices with off center striking. The primer assembly 1 can be adapted to different caliber sizes and different primer sizes.

Figure 4:
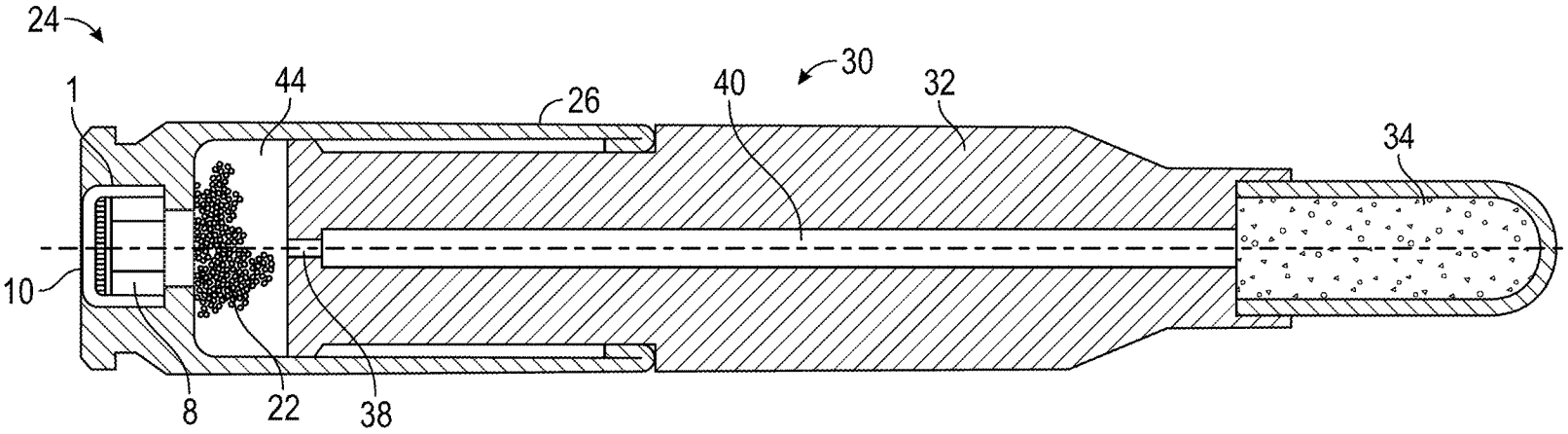
FIG. 4 is a cross-sectional side view of a simunition training cartridge comprising the primer and an additional propellant optionally being present in the cartridge.

FIG. 4 depicts a non-limiting example of a cartridge according to an embodiment. A cartridge 30 incorporates the primer assembly 1, along with additional propellant 22. The cartridge 30 has a head end 24 with an outer casing 26 that slidingly embraces a forward body 32 that carries a projectile 34 at its forward end. When a firing pin/striker or striker (not shown) strikes a portion of the base 10 of the cup 2 that abuts the lower surface 16 of the anvil 8, this activates the priming composition 4. If the center of the base 10 is struck with a firing pin/striker or striker, the priming composition will not ignite since no part of the anvil abuts the central portion of the base 10 due to the central channel 14 in the anvil 8.

Figure 5:
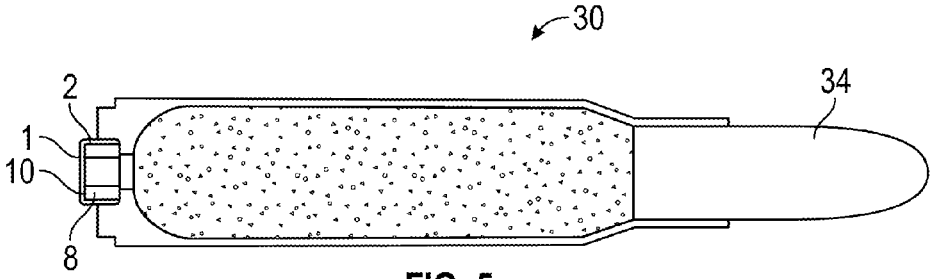
FIG. 5 is a cross-sectional side view of a cartridge comprising the primer.
Figure 6:
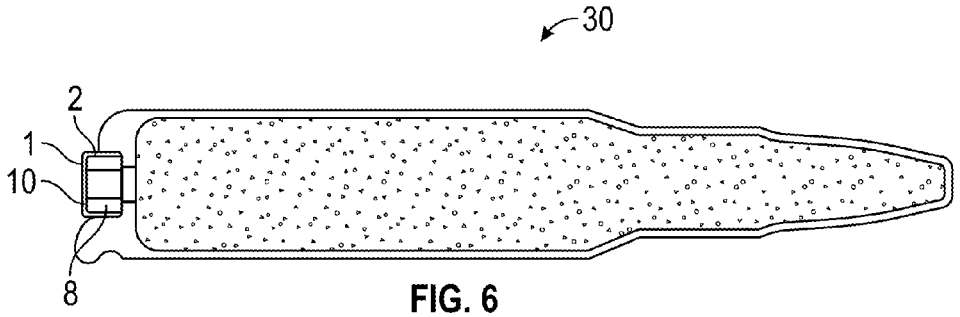
FIG. 6 is a cross-sectional side view of a blank cartridge comprising the primer.

FIG. 5 depicts a standard cartridge comprising the primer. The cartridge 30 is a standard cartridge comprising the primer and a projectile 34. FIG. 6 depicts a cartridge 30 comprising the primer assembly 1.

The embodiments are particularly useful for situations where the firing of live ammunition is to be prevented such as training exercises, play acting and stunts. Only special firearms that are designed for off center striking will fire ammunition having the primer assembly 1. Firearms built in such a way as to ignite center fire primers with center fire firing pin/striker will not be capable of firing ammunition having the primer assembly 1.

Primer assemblies in accordance with the embodiments (such as primer assembly 1 of FIG. 1), may be used in connection with any firearm having a pin/striker located at an appropriate off-center position. Such firearms include, for example, firearms that are particularly designed and manufactured with an off-center pin/striker, as well as traditional firearms that have been converted to fire primer assemblies in accordance with the embodiments.

In one embodiment, the firearm is modified such that the firing pin/striker strikes the cup 2 at a position that is offset from the center of the primer cup. The offset can be achieved by an offset chamber, re-positioned barrel or new bolt/bolt carrier mechanism that changes the location of the firing pin/striker. The firing pin/striker or the mechanism that the supports the firing pin/striker can be moved. The modified firearm is preferably built in such a way as to accommodate the firing pin/striker to the striking surface on the primer cup that is offset from the center of the primer cup.

Figure 7:
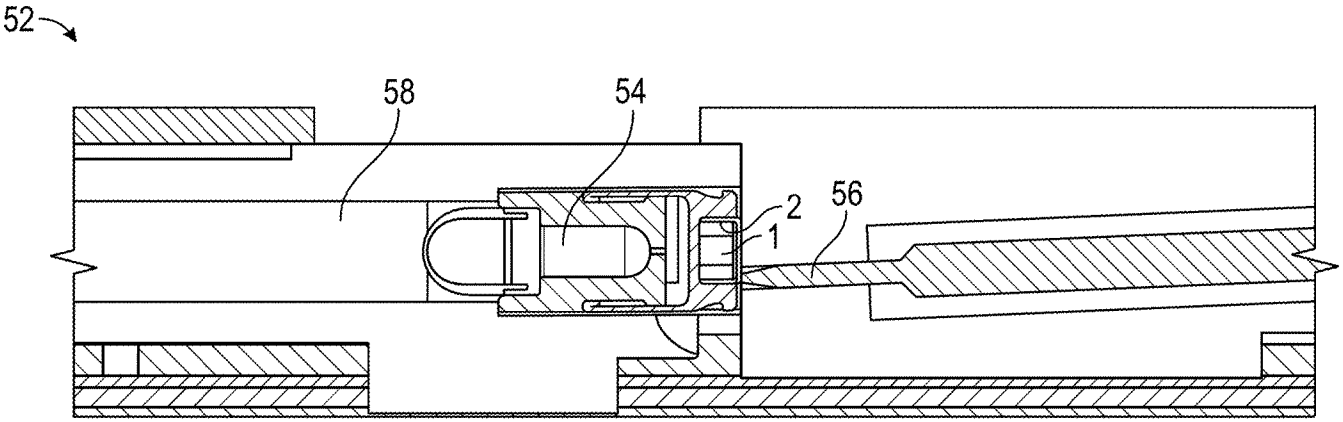
FIG. 7 is a cross-sectional view of a converted pistol.

FIG. 7 shows a cross-section of a modified pistol that is appropriate for use in association with the primer assembly. Pistol 52 is converted form a lock breach system to a pure blowback system. The pistol 52 is preferably modified for use in association with a cartridge 54 that is used for training purposes. An example of an appropriate cartridge is the Simunition™ cartridge produced by General Dynamics Ordnance and Tactical Systems—Canada Inc. The training cartridge described in Canadian Patent No. 2,419,861 is also appropriate for use. The cartridge includes the primer assembly 1 having the cup 2. A firing pin/striker 56 is positioned at an angle and offset from the barrel 58 of the pistol such that it is offset downwardly relative the barrel 58. When the cartridge 54 is forced to the proper depth in the chamber of the pistol, the firing pin/striker will strike the cup off center thereby igniting the primer. It should be noted that the firing of striker could be positioned also sideways such that it strikes the primer off center, therefore igniting primer.

Figure 8:
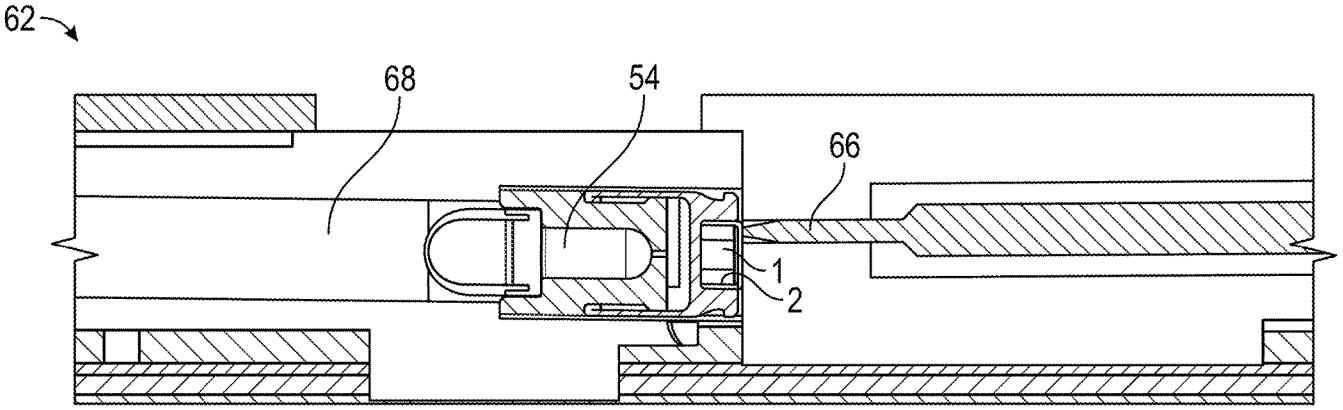
FIG. 8 is a cross-sectional view of a converted pistol according to an embodiment.

FIG. 8 shows an alternate embodiment of a modified pistol 62 where the barrel 68 is offset downwardly relative to the firing pin/striker 66. The firing pin/striker 66 is positioned in a standard position. When the cartridge 54 is forced to the proper depth in the chamber of the pistol, the firing pin/striker 66 will strike the cup 2 at an upward edge thereof and off center thereby igniting the primer. The modified pistol shown in FIG. 7 and FIG. 8 will not ignite a center fire primer assembly since the firing pin/striker strikes the primer cup off center.

Figure 9:
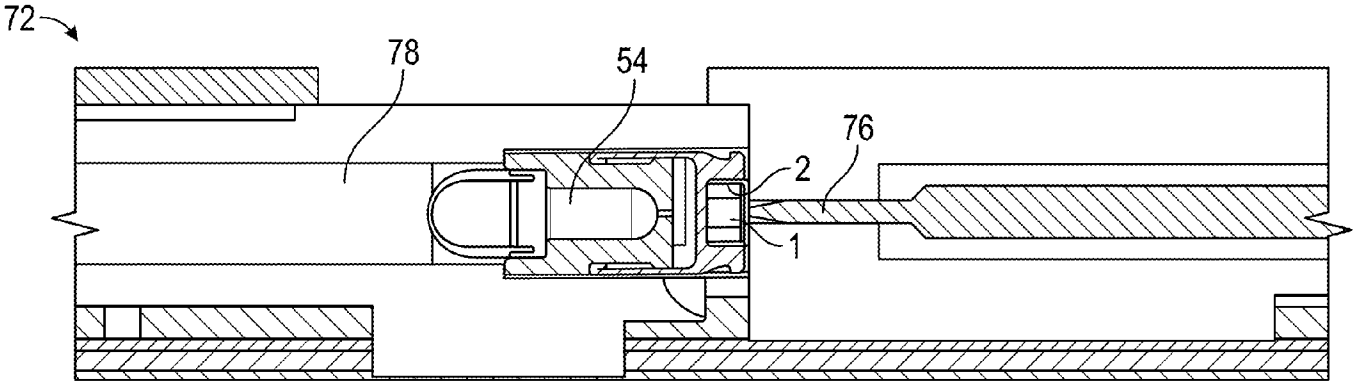
FIG. 9 is a cross-sectional view of a second converted pistol according to an embodiment.

FIG. 9 shows another alternate embodiment of a modified pistol 72 that is appropriate for use in association with the cartridge 54. In this embodiment, the firing pin/striker 76 is positioned in a standard straight position and hits the primer cup in the center. This embodiment will not initiate ignition of the primer for the primer assembly, but will ignite a center fire primer assembly.

Figure 10:
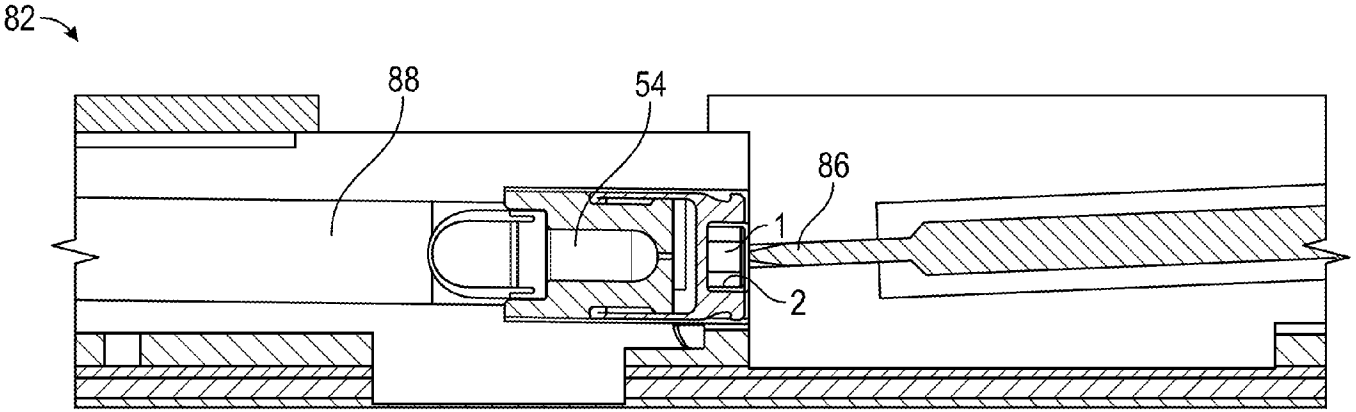
FIG. 10 is a cross-sectional view of a third converted pistol according to an embodiment.

FIG. 10 shows yet another embodiment of a modified pistol 82 that is used in association with a cartridge 54. In this embodiment, the firing pin/striker 86 and the barrel 88 are both offset and angled such that the firing pin/striker hits the primer cup in the center. This embodiment also will not initiate ignition of the primer for the primer assembly, but will ignite a center fire primer assembly.

In the case of a pistol that is modified for use in association with a training cartridge, the chamber and the firing pin/striker may be configured to efficiently feed, fire and eject the cartridge. With the modified pistols shown in FIGS. 7-10, the pistol is converted from a lock breach system to a pure blowback system.

Figure 11:
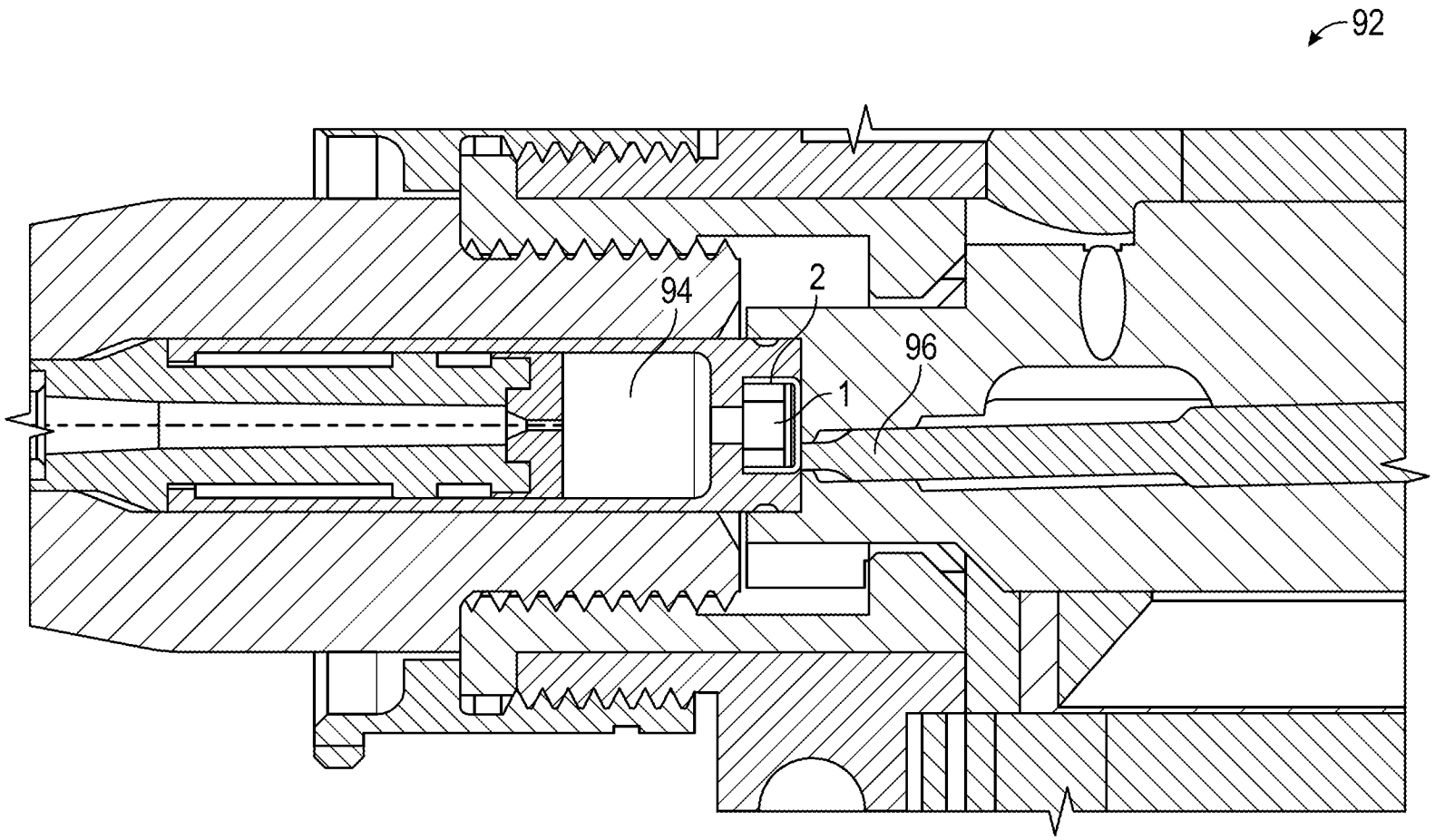
FIG. 11 is a cross-sectional view of a converted rifle according to an embodiment.

FIG. 11 shows a rifle 92 or sub-machine gun. The modified rifle can be used in association with training cartridges including a 5.56 mm of a 9 mm Simunition™ training cartridge 94, for example. The rifle 92 is modified to replace a locking system with a pure blowback system. However the rifle may be a true blow back system, delayed system, or any other rifle operating system. The firing pin/striker 96 is positioned to ignite the primer assembly 1 as it will strike the cup 2 off center. The firing pin/striker 96 can be positioned in a number of different orientations such as up, down and sideways such that it strikes the primer cup off center.

Figure 12:
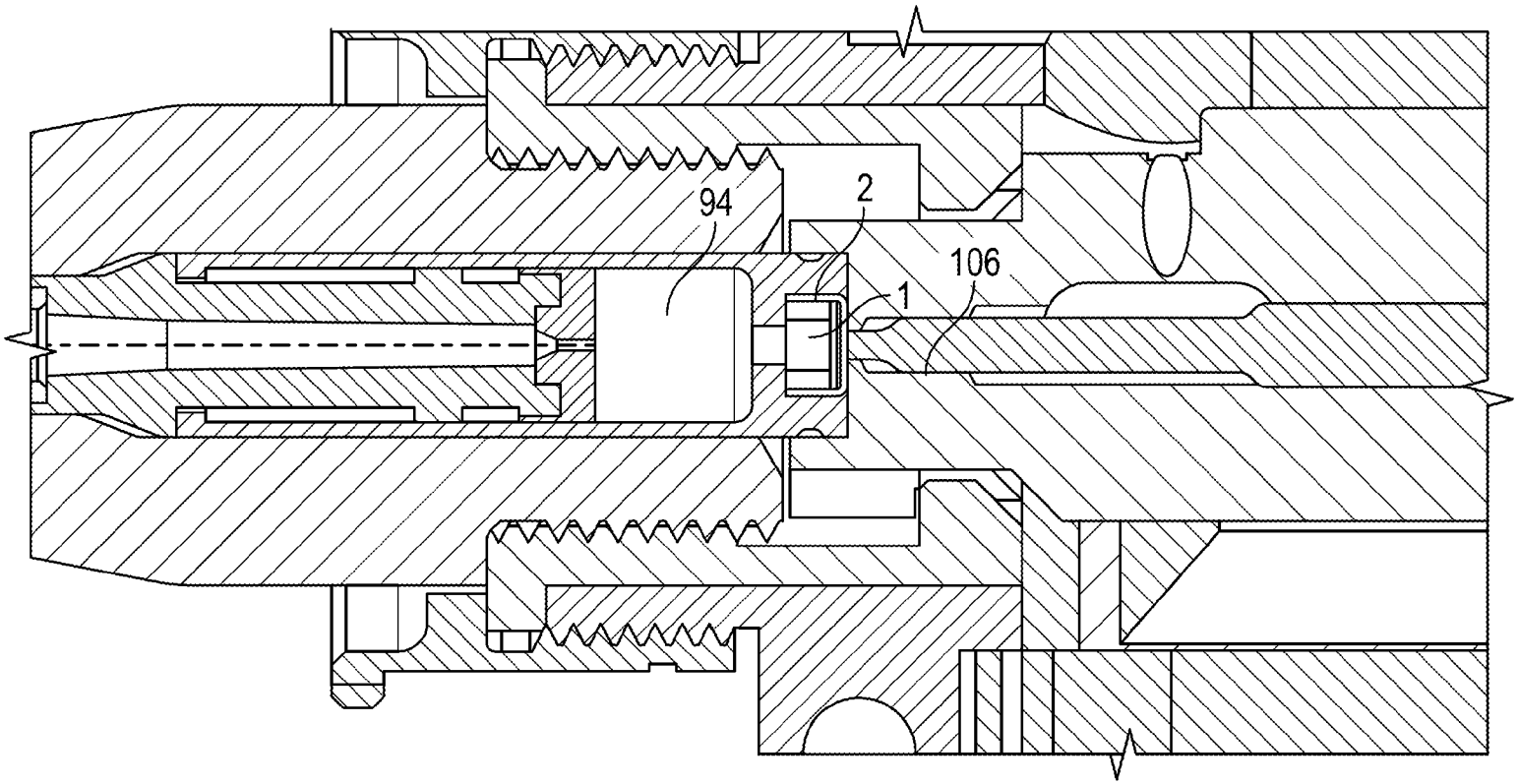
FIG. 12 is a cross-sectional view of an alternate converted rifle according to an embodiment.

FIG. 12 shows another modified rifle or sub-machine gun 102 that can be used with training cartridges 84 including a 5.56 mm of a 9 mm training cartridge. This sub-machine gun 102 has a firing pin/striker 106 that is adapted to strike the center of a primer cup. It would accordingly not ignite the primer assembly, but would ignite a center fire primer.

It is clear that in preparing modified firearms, there are many combinations of offsetting the firing pin/striker, barrel and bolt/bolt carrier assembly that can be employed in order to determine which portion of the primer cup will be struck by the firing pin/striker.

These claims, and the language used therein, are to be understood in terms of the variants of the invention which have been described. They are not to be restricted to such variants, but are to be read as covering the full scope as is implicit within the invention and the disclosure that has been provided herein. While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. An ammunition primer assembly comprising:

a cup having a base and a sidewall;

a priming composition located in said cup and disposed on said base;

an anvil located in said cup, said anvil having an upper surface, a lower surface and a side surface abutting said sidewall, said anvil defining a central channel formed therethrough;

a longitudinal axis extending through a center of said base, said priming composition, and said central channel;

a striking surface defined as a portion of the base, said striking surface adjacent to a portion of said priming composition that is interposed between the lower surface of said anvil and the cup, said striking surface offset from a center of said base such that, when a central area of the base that intersects with said longitudinal axis and is surrounded by said striking surface is struck, the priming composition is not activated, and such that when the striking surface is struck the priming composition is activated.

2. An ammunition primer assembly according to claim 1, further comprising a sealing disc disposed between said priming composition and said anvil.

3. An ammunition primer assembly according to claim 1, wherein the anvil is cylindrical in shape.

4. An ammunition primer assembly according to claim 1, wherein said lower surface of said anvil is flat.

5. An ammunition primer assembly according to claim 1, wherein said striking surface is offset from a center of said cup.

6. An ammunition primer assembly according to claim 1, wherein said striking surface is offset from a center of said base in an amount of from 25% to 50% of a diameter of the base.

7. An ammunition primer assembly according to claim 1, wherein the cup and the anvil are constructed of brass.

8. An ammunition primer assembly according to claim 1, wherein the cup and the anvil are metallic.

9. An ammunition primer assembly according to claim 1, wherein the cup is non-metallic.

10. An ammunition primer assembly according to claim 1, further comprising a cartridge case having an interior cavity without a projectile.

11. An ammunition primer assembly according to claim 1, wherein the anvil and the cup are complimentary in shape.

12. An ammunition primer assembly according to claim 1, wherein the anvil is received snugly in the cup.

13. An ammunition cartridge comprising:

an ammunition primer assembly including:

a cup having a base and a sidewall;

a priming composition located in said cup and disposed on said base;

an anvil located in said cup, said anvil having an upper surface, a lower surface and a side surface abutting said sidewall, said anvil defining a central channel formed therethrough;

a longitudinal axis extending through a center of said base, said priming composition, and said central channel;

wherein a portion of the base of the cup forms a striking surface, said striking surface being adjacent to a portion of said priming composition that is sandwiched between the lower surface of said anvil and the cup, said striking surface being offset from a center of said base such that, when a central area of the base that intersects with said longitudinal axis and is surrounded by said striking surface is struck, the priming composition is not activated, and such that when the striking surface is struck the priming composition is activated;

a casing assembly configured to incorporate the ammunition primer assembly; and a propellant disposed within the casing assembly adjacent to the ammunition primer assembly.

14. The ammunition cartridge of claim 13, wherein the casing assembly includes an outer casing, a forward body slideably embraced by the outer casing, and a projectile carried by the forward body.

15. The ammunition cartridge of claim 13, wherein the casing assembly includes an outer casing and a projectile carried by a forward portion of the outer casing.

16. The ammunition cartridge of claim 13, wherein the anvil is cylindrical in shape.

17. The ammunition cartridge of claim 13, wherein said circular striking surface is offset from a center of the cup.

18. The ammunition cartridge of claim 13, wherein the anvil and the cup are complimentary in shape.

* * * * *